US009480352B2

(12) United States Patent
Burton et al.

(10) Patent No.: US 9,480,352 B2
(45) **Date of Patent: *Nov. 1, 2016**

(54) UTENSIL HOLDING AND TURNING DEVICE

(71) Applicants: Patricia A. Burton, Boerne, TX (US); Donald W. Burton, Boerne, TX (US)

(72) Inventors: Patricia A. Burton, Boerne, TX (US); Donald W. Burton, Boerne, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/869,860

(22) Filed: Sep. 29, 2015

(65) Prior Publication Data

US 2016/0081503 A1 Mar. 24, 2016

Related U.S. Application Data

(63) Continuation-in-part of application No. 14/490,322, filed on Sep. 18, 2014, now Pat. No. 9,145,711.

(51) Int. Cl.

| | |
|---|---|
| ***A47G 21/08*** | (2006.01) |
| ***A45F 5/10*** | (2006.01) |
| ***E05B 19/00*** | (2006.01) |
| *E05B 1/00* | (2006.01) |

(52) U.S. Cl.

CPC ..... *A47G 21/08* (2013.01); *A45F 5/10* (2013.01); *E05B 19/00* (2013.01); *E05B 1/0053* (2013.01)

(58) Field of Classification Search

CPC ..... E05B 19/04; E05B 19/00; E05B 19/043; E05B 1/0053; A44B 15/00; A45C 11/324; B25G 1/00; A47J 43/28; A47G 21/08; A45F 5/10

USPC ..... 81/436, 487; 70/408, 456 R; D8/16

See application file for complete search history.

(56) References Cited

U.S. PATENT DOCUMENTS

| | | | | |
|---|---|---|---|---|
| 1,175,902 A | | 3/1916 | Peterson | |
| 2,252,119 A | * | 8/1941 | Edmonds | A61J 7/0023 141/25 |
| 3,612,358 A | * | 10/1971 | Massa | A61J 7/0046 222/191 |
| 3,863,693 A | | 2/1975 | Carriker | |

(Continued)

FOREIGN PATENT DOCUMENTS

WO WO 2010130949 A1 * 11/2010 ..... A47J 43/28

OTHER PUBLICATIONS

ParaQuad—Department of Veterans Affairs (DVA) Mobility Functional Support Program (MFS), Key 2 Double Key Turner—Blue—H6242, Jun. 7, 2014, p. 1 of 2, https://paraquad.org.au/DVA-MFS/webstore/key-2-double-key-turner-blue-h6242.

(Continued)

*Primary Examiner* — Suzanne Barrett
(74) *Attorney, Agent, or Firm* — Kammer Browning PLLC

(57) ABSTRACT

A device attachable to a utensil that allows an individual with limited dexterity to handle the utensil and use it according to its ordinary function. The device provides a Y-shaped handle, such as that structured by a section of antler, that attaches to a utensil and provides the geometric and structural requirements necessary for the user to pick up the utensil from a flat surface, direct the utensil near the material to be manipulated, and manipulate the utensil once positioned. The Y-shaped component is curved across its height and provides a wedge engagement structure to permit holding the device with utensil to exert a force directing the utensil into the material to be manipulated, and by a combination of forces exerted by the palm and the thumb, to grasp and manipulate the device combination in order to make appropriate use of the utensil for its intended purpose.

10 Claims, 6 Drawing Sheets

(56) References Cited

U.S. PATENT DOCUMENTS

| | | | | |
|---|---|---|---|---|
| 4,000,767 | A | 1/1977 | Geng | |
| 4,035,865 | A | 7/1977 | McRae et al. | |
| 4,036,040 | A | 7/1977 | Graizzaffi | |
| 4,504,087 | A | 3/1985 | Pennington | |
| 4,583,383 | A | 4/1986 | Bosco et al. | |
| 4,910,983 | A | 3/1990 | Taylor | |
| 5,058,465 | A | 10/1991 | Womack | |
| 5,207,082 | A | 5/1993 | LeMaitre | |
| 5,440,910 | A | 8/1995 | Florian | |
| 5,737,951 | A | 4/1998 | Krass | |
| 5,794,471 | A | 8/1998 | Rizzo | |
| 6,279,233 | B1 * | 8/2001 | Cameron | A61J 7/0046 30/125 |
| 6,557,264 | B1 * | 5/2003 | Maeda | A47J 43/28 15/236.01 |
| 6,578,397 | B1 | 6/2003 | Altrich et al. | |
| 6,598,438 | B2 | 7/2003 | Ashby | |
| 7,240,527 | B2 | 7/2007 | Boyd | |
| D583,648 | S | 12/2008 | Cushman | |
| 8,424,350 | B2 | 4/2013 | Bernatchez | |
| D707,090 | S | 6/2014 | Walls | |
| 9,145,711 | B1 * | 9/2015 | Burton | E05B 19/00 |

OTHER PUBLICATIONS

The Wright Stuff, Key Turners :: Aids for Turning Car Keys, House Keys, Jun. 7, 2014, p. 1 of 2, http://www.wrightstuff.biz/keyturners.html.

R & J Mobility Service, Inc., Disabled Driving Aids, Turn Signal Extensions, Steering Device Extension, Jun. 7, 2014, p. 3 of 5, p. 4 of 5, http://rjmobilityservice.com/mobility-products/driving-aids/other-driving-aids/.

* cited by examiner

UTENSIL HOLDING AND TURNING DEVICE

CROSS REFERENCE TO RELATED APPLICATIONS

This application claims the benefit under 35 U.S.C. §120 of co-pending U.S. patent application Ser. No. 14/490,322; Filing Date: Sep. 18, 2014; Entitled: Key Holding and Turning Device, the full disclosure of which is incorporated herein by reference.

BACKGROUND OF THE INVENTION

1. Field of the Invention

The present invention relates generally to devices that facilitate the use of everyday objects by individuals with limited manual dexterity. The present invention relates more specifically to a device that facilitates the use of ordinary utensils by individuals that may have difficulty grasping and/or turning a utensil in its intended manner.

2. Description of the Related Art

Many individuals with a wide range of physiological and neurological conditions have difficulty handling and manipulating keys. The use of a typical key involves the process of picking the key up, grasping the key appropriately, inserting the key into a lock or switch, and then rotating or turning the key to activate the lock or activate the switch. All of these actions required with the use of a key are quite difficult for those that have little or no manual dexterity.

Some efforts have been made in the past to provide devices and tools for use by those who have difficulty holding ordinary objects in their hands (such as eating utensils) to permit the disadvantaged user to appropriately manipulate the tool or device in a manner that approaches ordinary use. In most cases, such efforts in the past have simply created larger or more gripable handles with friction surfaces that allow the user to engage a loose grip around the device and still utilize it to an extent. None of the previous efforts along these lines, however, have been able to provide a means for properly manipulating an ordinary key in the manner typically required to carry out its full function. The mere attachment of a larger or longer handle to the key does little or nothing for the user's ability to turn the key once it has been inserted into the lock or latch. It is the unique properties of a typical key that require more than simply increasing the size of the grasping surface area to fully permit a disadvantaged user to carry out the functions associated with the use of a key.

It would be desirable, therefore, to have a tool, to which a key might be attached, that provides an individual with low manual dexterity the ability to pick up a key from a flat surface, grasp the key in a manner sufficient to direct its insertion into a lock or switch, rotate or turn the key once it has been inserted into the lock or switch, and finally, to retain the overall key holding device on the user's wrist even if the grip on the device is lost. It would be desirable if such a device could be manufactured from readily available materials that provide the necessary structure and geometry to facilitate each of the actions required with the use of a key.

SUMMARY OF THE INVENTION

The present invention provides a device attachable to an ordinary key that allows an individual with limited manual dexterity to handle the key and use it according to its ordinary function. The present invention provides a Y-shaped handle, typified by a section of naturally occurring antler or branched wood, that attaches to a key and provides each of the geometric and structural requirements necessary to pick up the key from a flat surface, insert the key into a lock or switch aperture, and finally turn the key once inserted. The Y-shaped component is curved across its height dimension, such that when the device is attached to a key, and the combination assembly is placed on a flat surface, some portion of the device will always extend above the flat surface.

In addition, the Y-shaped geometry of the device provides a yoke engagement structure appropriate for combining with the user's hand in an open palm configuration so as to permit the holding of the device with key, to exert in the appropriate direction a force sufficient to insert the key into a lock or switch, and finally by a combination of forces exerted by the front of the palm and the back of the thumb of the user's hand (or by the front of the thumb and the back of the hand), to rotate the key/device combination in order to activate the lock or switch. A first preferred embodiment of the present invention involves the selection and use of an appropriately configured portion of antler, such as a deer antler. Once a section of antler has been identified as meeting the requirements for three-dimensional curvature, geometry of the Y-shaped yoke, length of the lever arms, and overall device length, it may be attached to an ordinary key utilizing a screw or bolt positioned through an aperture drilled through the antler material. In addition, a second aperture may be positioned on the antler material through which a lanyard section may be placed in order to create a looped retention cord sufficient to maintain the device with key around the user's wrist, even if the grip on the device is lost. Alternate embodiments of the invention may utilize naturally occurring or individually crafted sections of wood formed into the same Y-shaped yoke configuration described above in conjunction with the antler material. Alternately, other types of material may be utilized and either molded or shaped into the configurations described in association with the preferred embodiment to produce the same effective key attachment device that may be utilized by those with limited manual dexterity.

BRIEF DESCRIPTION OF THE DRAWINGS

FIG. 4 is a top view of these dimensions, while FIG. 5 is an elevational view.

DETAILED DESCRIPTION OF THE DRAWINGS

Figure 1:
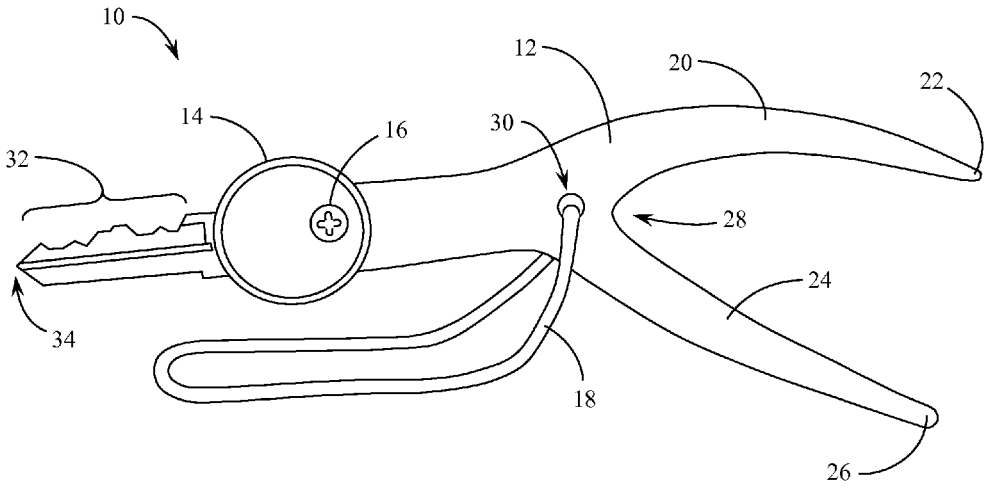
FIG. 1 is a top plan view of the key holding and turning device of the present invention.
Figure 2:
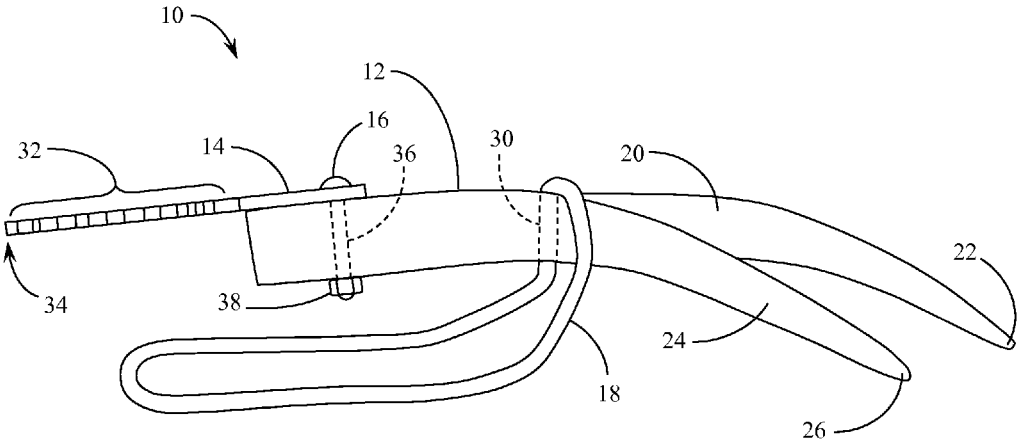
FIG. 2 is an elevational side view of the key holding and turning device of the present invention.

Reference is made first to FIGS. 1 & 2 for a detailed description of a first preferred embodiment of the present invention. FIG. 1 shows a top plan view of the key holding and turning device assembled with a typical key, such as might be used in conjunction with a door lock or ignition switch. Key holding and turning device 10 is generally configured with Y-shaped handle 12 supporting a typical key 14. Key 14 is attached to Y-shaped handle 12 by way of key attachment screw 16 (with locking nut 38 as shown in FIG. 2). The only additional assembled component making up key holding and turning device 10 is retention lanyard 18. As discussed above, key holding and turning device 10 of the present invention is intended for use by individuals with limited gripping or grasping ability in conjunction with a small object such as a key. This same limitation may translate into difficulty holding onto the device of the present invention which makes the use of retention lanyard 18 a preferable form of the assembly.

The essential features of Y-shaped handle 12 include handle palm extension 20 and handle thumb extension 24. The manner in which the hand of the user might typically engage Y-shaped handle 12 is described in more detail below with respect to FIG. 3. Handle palm extension 20 terminates with palm extension tip 22 as shown. In a similar manner, handle thumb extension 24 terminates with thumb extension tip 26. These two extensions 20 & 24 extend from the main body of Y-shaped handle 12 in the area of handle engagement yoke 28 that, with the hand of the user, engages to direct a turning force to the key holding and turning device 10 and therefore to key 14. Handle lanyard aperture 30 is provided through the body of Y-shaped handle 12 to appropriately secure retention lanyard 18. Again, the manner in which the user engages both retention lanyard 18 and handle engagement yoke 28 is described in more detail below.

Key 14, secured to Y-shaped handle 12 by way of key attachment screw 16 with locking nut 38, may be any of a number of different types of keys typically utilized by individuals to gain access through doors, cabinets, trunks and the like, or to activate ignition switches, electrical systems, and other objects typically designed to provide access or activation by way of a key. Key 14 will typically have a machined key edge 32 terminating in key tip 34. The arrangement of key 14 on Y-shaped handle 12 is generally such as to form an axis extending away from handle palm extension 20 and handle thumb extension 24. This provides an axis for both directing an insertion force to position the key in the lock, as well as an axis for rotating the key once it has been inserted. The geometry of this process is described in more detail below with a description of FIG. 4.

FIG. 2 provides a side elevational view of the key holding and turning device of the present invention as initially disclosed in FIG. 1. The view of FIG. 2 shows the manner in which handle palm extension 20 and handle thumb extension 24 curve to provide a three dimensional height to the overall key holding and turning device 10. In the view of FIG. 2, handle palm extension 20 is seen to extend co-axially with the main body of Y-shaped handle 12 to approximately a mid-point where it begins to curve downward towards palm extension tip 22. In a similar manner, handle thumb extension 24 is initially connected to the body of Y-shaped handle 12 at a point adjacent handle lanyard aperture 30 before it curves downward to terminate in thumb extension tip 26. The benefits of having this curvature to the structure are described in more detail below with regard to FIG. 5.

Also visible in FIG. 2 is additional detail showing the manner in which key 14 is secured to Y-shaped handle 12. Using key attachment screw 16, which extends through key attachment aperture 36, key 14 may be semi-permanently positioned on Y-shaped handle 12 by the attachment of key attachment locking nut 38 to key attachment screw 16. In the view of FIG. 2, retention lanyard 18 is shown to extend through handle lanyard aperture 30 to form a closed loop that the user may slip around a wrist in order to retain key holding and turning device 10 even if their hand fails to maintain a grasp of the device.

Figure 3:
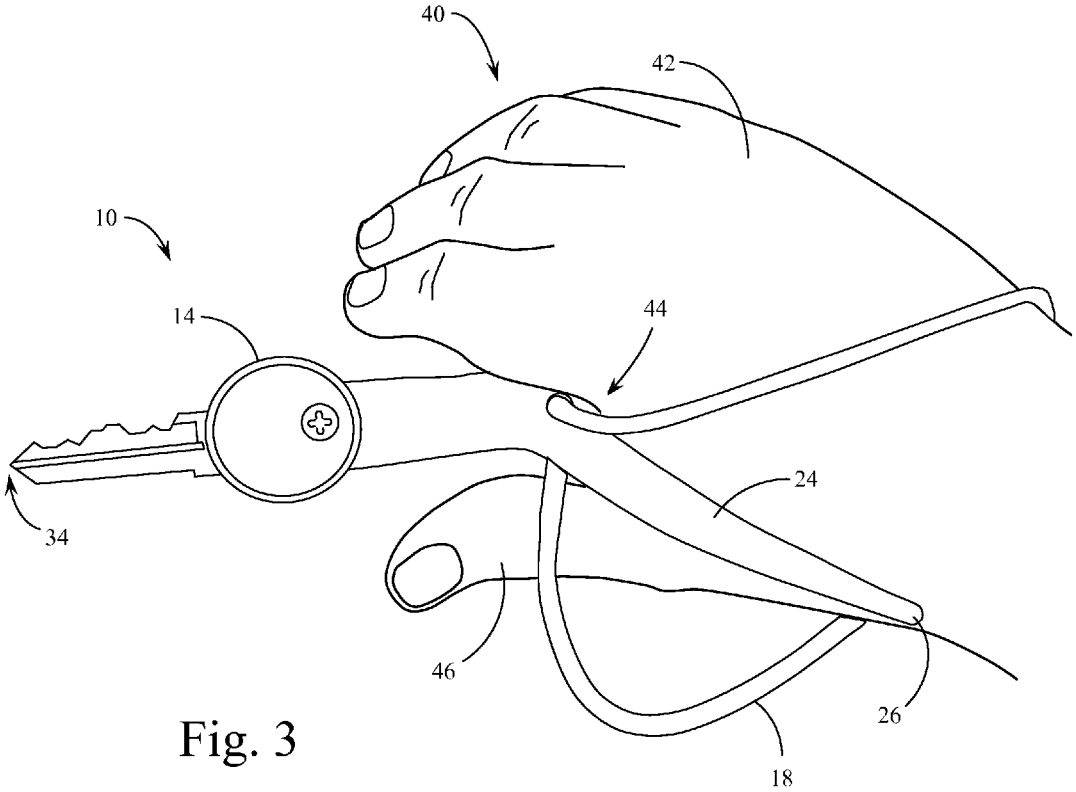
FIG. 3 is a perspective view of the key holding and turning device of the present invention as engaged by a human hand.

Reference is next made to FIG. 3, which is a perspective view of key holding and turning device 10 of the present invention as engaged by a human hand. It will be recognized by those skilled in the art that, although FIG. 3 represents the use of a right hand with the key holding and turning device 10, a mirror image of the device may easily be implemented with the left hand of the user in precisely the same manner. FIG. 3 shows the user's hand 40 engaging key holding and turning device 10 after having positioned retention lanyard 18 around hand 40 to extend loosely around the wrist of the user. In FIG. 3 the back 42 of the hand is shown opposite the side where the palm of the hand (not shown) engages the device of the present invention. The thumb 46 extends on an opposite side of the device from the balance of the hand, including the back of the hand and the four fingers as shown. Mid-way between the thumb 46 and the back 42 of the hand is the yoke of the hand 44, sometimes characterized as the thumb joint for the hand. It is the yoke of the hand 44 that engages the handle engagement yolk 28 (not seen in this view) and which directs a force longitudinally along Y-shaped handle 12 through key 14 and key tip 34 to provide the necessary force to direct the key into the lock and thereafter initiate the rotation of the key.

Rotation of key 14 once inserted into a lock is accomplished by the manner in which the palm of the hand (opposite the back 42 of the hand shown in FIG. 3) and the thumb 46 engage handle palm extension 20 and handle thumb extension 24, respectively. Although handle palm extension 20 is not seen in FIG. 3, it is understood that hand 40 may exert a force (into the page of the drawing in FIG. 3) that, because of the deviation of the extension from the turning axis of the device, provides a force which tends to rotate the device around that turning axis. In a similar manner, thumb 46 exerts a force (out of the page) on handle thumb extension 24 that reinforces this rotational movement. Therefore, when the user holds the device in the manner shown in FIG. 3, he or she is able to both direct an insertion force to secure the key in the lock (or switch), and a rotating force to turn the key in the lock (or switch). The combination of the frictional engagement forces between the palm of hand 40 and the handle palm extension 20, as well as the frictional forces of the back of the thumb 46 and handle thumb extension 24, allow the user to generally maintain key holding and turning device 10 within the confines of the slightly closed, but not gripped hand. Once again, retention lanyard 18 further supports the retention of the device adjacent the user's hand even if some loosening of the grip occurs.

Figure 4:
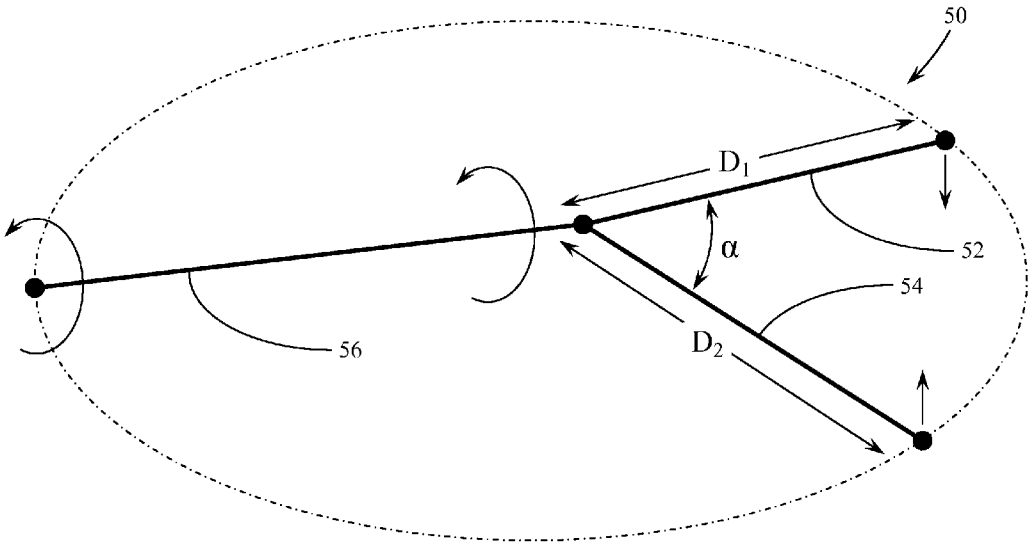
FIGS. 4 & 5 are geometric schematic diagrams disclosing the minimum and maximum dimensions and the angles for the various structural components of the key holding and turning device of the present invention.
Figure 5:
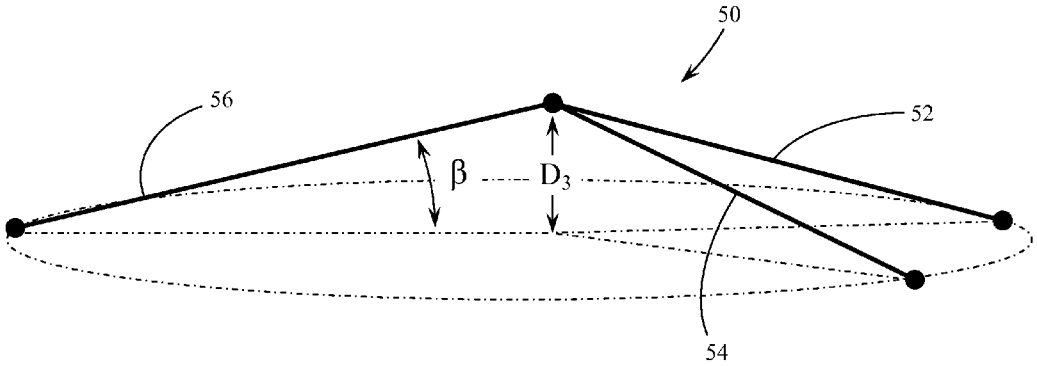

Reference is next made to FIGS. 4 & 5, which are geometric schematic diagrams that disclose the range of dimensions and angles for the various structural components of the key holding and turning device of the present invention. Although a preferred embodiment of the invention may be manufactured from an antler, such a structure will not universally be appropriate for use with the key holding and turning device of the present invention. In other words, there are limitations on the range of various geometric elements within the device that will make it suitable for use to insert and rotate a key in a lock or with a switch. These limitations are described in more detail in FIGS. 4 & 5.

FIG. 4 is a top view showing these dimensions and angles, while FIG. 5 is an elevational view. In FIG. 4, key holding and turning device functional geometry 50 is represented by lines and points of given distances arranged and separated by various angles. Palm lever arm 52 is shown to extend across the general area where the handle palm extension exists on the actual device. In a similar manner, thumb lever arm 54 extends in a manner approximately in the position of the handle thumb extension of the actual device. Palm lever arm 52 has a length $D_1$ and thumb lever arm 54 has a length $D_2$. While these lever arm components of the device of the present invention may vary in length significantly, they each should be no smaller than approximately an inch and a half to two inches in length, and no longer than four to six inches in length. If dimensions $D_1$ and $D_2$ are less than about an inch to an inch and a half, then the typical user's hand is too large to fit into the yoke formed by the extensions. If the dimensions $D_1$ and $D_2$ are too large (i.e., greater than four to six inches), then the overall device becomes cumbersome and difficult to carry, store, and manipulate. Dimensions $D_1$ and $D_2$ are therefore preferably in the range of one and a half to six inches.

Hand yoke angle $\alpha$ is the angle formed between palm lever arm 52 and thumb lever arm 54. The range of acceptable angles $\alpha$ that may be used in the present invention is wide, but does have limitations. In general, nothing smaller than a 20° angle for $\alpha$ is preferable in order to allow the hand to fully engage the yoke and to provide appropriate insertion force for the key without pinching the hand. Likewise, angle $\alpha$ should generally be no greater than 80° in order for both the palm of the hand to engage the handle palm extension and the thumb of the hand to fully engage the handle thumb extension. Much larger than 60° for angle $\alpha$ and the user is forced to open their hand in order to fully engage the lever arms for rotation of the key.

Key turning axis 56 is shown to extend generally along the main body of the Y-shaped handle as well as the extended turning axis of the key attached to the Y-shaped handle. The length of key turning axis 56 from its point of attachment to palm lever arm 52 and thumb lever arm 54 is perhaps not as critical as the length of each of the above described lever arms. Nonetheless, the overall device of the present invention preferably does not exceed six to eight inches.

Also shown in FIG. 4 are force direction lines that extend down from palm lever arm 52 and up from thumb lever arm 54 to indicate the manner in which these two lever arms exert a rotational force on key turning axis 56. The rotational arrows shown associated with key turning axis 56 result from the imparting of the forces described above. It is understood that force direction lines in the opposite direction would represent the reverse rotation around the key turning axis 56 to achieve a key function the opposite of that initially described (such as turning off an ignition switch).

FIG. 5 represents an elevational view of the geometric diagram shown in FIG. 4 and is intended to describe less about the manipulation of the device of the present invention during use, and more about its configuration when not in use resting on a flat surface. For the same reason that many users will find benefit in the manipulation of the device of the present invention for inserting and turning a key, those same users will find benefit in the curved profile of the device so that it might easily be picked up from a flat surface. Absent a raised profile, the device itself might be difficult to pick up with a hand that does not entirely close around or grasp small objects. FIG. 5 also shows key holding and turning device functional geometry 50, made up primarily of palm lever arm 52, thumb lever arm 54, and key turning axis 56.

The important feature shown in FIG. 5 is distance $D_3$, which is the device peak height. By requiring that the handle palm extension and the handle thumb extension be curved away from the yoke engagement point, the overall engagement device will have a profile that permits it to be easily picked up from a flat surface. This distance $D_3$ shown in FIG. 5 is therefore preferably in the range of one-half inch to an inch and a half. Much less than a half inch and the device becomes difficult to pick up. Much more than an inch and a half and the device becomes too non-linear to be easily manipulated in the hand.

The elevation $D_3$ is, of course, determined in part by the length of the lever arms and the turning axis, as well as angle $\beta$ between a flat surface and key turning axis 56. This angle $\beta$ in the preferred embodiment (which could just as easily be associated with either of the two lever arms mentioned) is preferably in the range of 10° to 30°. Much smaller than 10° and distance $D_3$ may only be established by having a very long key turning axis 56. Much more than 30° and a given length of key turning axis 56 provides too tall a distance $D_3$.

Once again, although the present invention has been described as preferably being manufactured from an antler component having angles and dimensions within the ranges described above, those skilled in the art will recognize that other materials may be utilized to construct the handle portion of the device and still retain the same dimensional characteristics.

Figure 6:
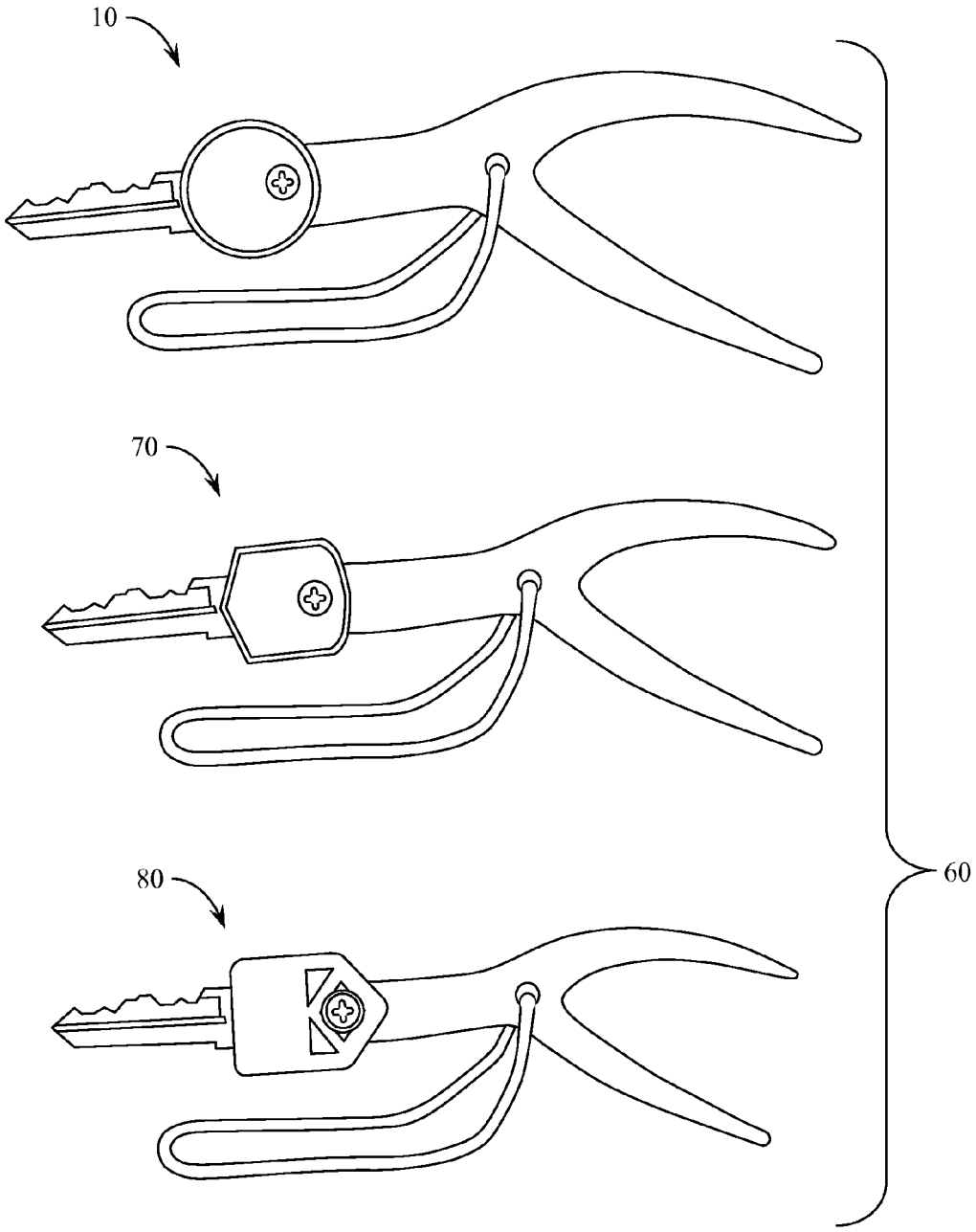
FIG. 6 is an assembly view showing a variety of different sizes and key types for the key holding and turning device of the present invention.

Reference is finally made to FIG. 6 which provides a view of a variety of different key types and sizes for the key holding and turning device of the present invention. The intention in FIG. 6 is to show the variability, not only with the types of keys that might be utilized with the device of the present invention, but also with the overall dimensions of the device itself as may be appropriate for hands of different sizes. Size variation group 60 in FIG. 6 discloses the same key holding and turning device (large size) 10 described in more detail above as a first example, as well as key holding and turning device (medium size) 70 and key holding and turning device (small size) 80. Each of these examples will generally have geometric configurations within the ranges described above, but are scaled so as to permit the most comfortable and secure use of a particular key with hands of a particular size. Again, the objective of sizing the overall device and establishing limitations on the length and angle of the various extensions is to balance the security of engagement between the hand and the device with the comfort of the user. Also important is the process of directing an insertion force with the device and thereafter directing a rotational force with the device. The primary goal of not requiring a firm grip on the device is established by providing the Y-shaped handle having the geometry generally described above.

ALTERNATE PREFERRED EMBODIMENTS

Figure 7:
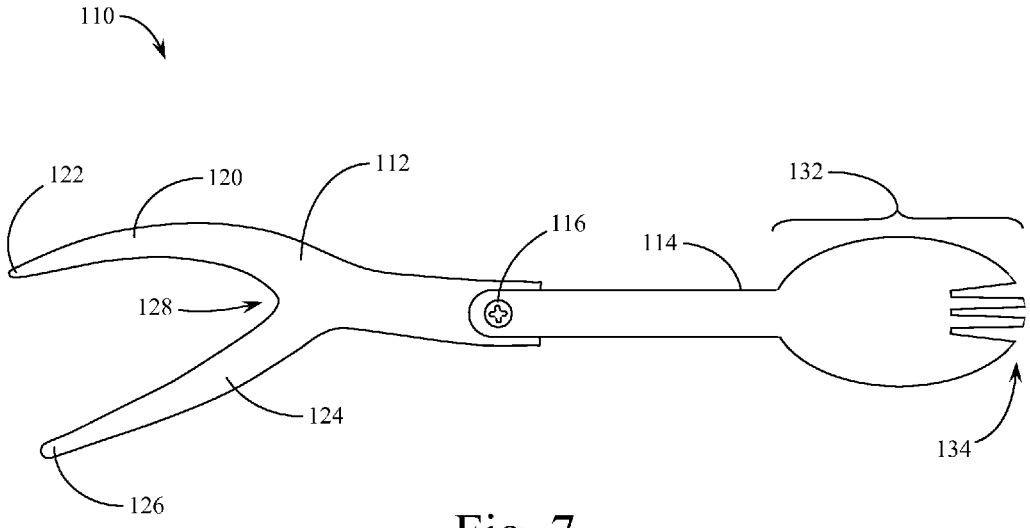
FIG. 7 is a top plan view of the utensil holding and turning device of the present invention.
Figure 8:
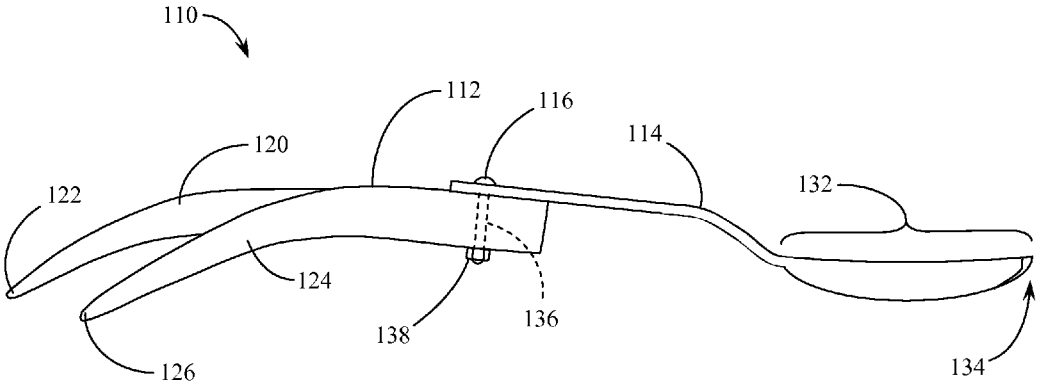
FIG. 8 is an elevational side view of the utensil holding and turning device of the present invention.

Reference is made next to FIGS. 7 & 8 for a detailed description of an alternate preferred embodiment and use of the present invention. FIG. 7 shows a top plan view of the utensil holding and turning device assembled with a typical eating utensil, such as a spoon, fork, or the combination spoon/fork shown. Utensil holding and turning device 110 is generally configured with the same Y-shaped handle 112 supporting a typical utensil 114. Utensil 114 is attached to Y-shaped handle 112 by way of attachment screw 116 (with locking nut 138 as shown in FIG. 8). An optional component not shown in FIGS. 7 & 8 but useful in the same manner as in the key holding and turning device (see FIG. 1) is a retention lanyard. As discussed above, utensil holding and turning device 110 of the present invention is intended for use by individuals with limited gripping or grasping ability in conjunction with objects that may be difficult to grip and/or manipulate such as an eating utensil. This same limitation may translate into difficulty holding onto the device of the present invention which makes the use of a retention lanyard a optional form of the assembly shown.

The essential features of Y-shaped handle 112 include handle palm extension 120 and handle thumb extension 124. The manner in which the hand of the user might typically engage Y-shaped handle 112 is described in more detail below with respect to FIG. 9. Handle palm extension 120 terminates with palm extension tip 122 as shown. In a similar manner, handle thumb extension 124 terminates with thumb extension tip 126. These two extensions 120 & 124 extend from the main body of Y-shaped handle 112 in the area of handle yoke 128 in such a manner that the hand of the user may engage (wrap around) a wedge shaped portion of Y-shaped handle 112 to provide not only a better grip but also a better manipulation of the utensil holding and turning device 110 and therefore of utensil 114.

Utensil 114, secured to Y-shaped handle 112 by way of attachment screw 116 with locking nut 138, may be any of a number of different types of utensils typically utilized by individuals that require gripping and manipulation. Eating utensils, such as that shown in the drawing figures, are one example. Others include screwdrivers, brushes, scrapers, saw blades, knives, cooking utensils, BBQ utensils, gardening hand tools, and many additional small utility devices that require gripping and manipulation for effective use.

Utensil 114 will typically have an operable head portion 132 terminating in a utensil tip 134. The arrangement of utensil 114 on Y-shaped handle 112 is generally such as to form an axis extending away from handle palm extension 120 and handle thumb extension 124. This provides an axis for both directing a forward motion to position the utensil in or on the material being manipulated, as well as an axis for tilting or rotating the utensil once it has engaged the material being manipulated. The geometry of this process is similar to that described in more detail above with a description of FIG. 4.

FIG. 8 provides a side elevational view of the utensil holding and turning device of the present invention as initially disclosed in FIG. 7. The view of FIG. 8 shows the manner in which handle palm extension 120 and handle thumb extension 124 curve to provide a three dimensional height to the overall utensil holding and turning device 110. In the view of FIG. 8, handle palm extension 120 is seen to extend co-axially with the main body of Y-shaped handle 112 to approximately a mid-point where it begins to curve downward towards palm extension tip 122. In a similar manner, handle thumb extension 124 is initially connected to the body of Y-shaped handle 112 before it curves downward to terminate in thumb extension tip 126. The benefits of having this curvature to the structure are the same as described in more detail above with regard to FIG. 5.

Also visible in FIG. 8 is additional detail showing the manner in which utensil 114 is secured to Y-shaped handle 112. Using attachment screw 116, which extends through attachment aperture 136, utensil 114 may be semi-permanently positioned on Y-shaped handle 112 by the attachment of attachment locking nut 138 to attachment screw 116.

Figure 9:
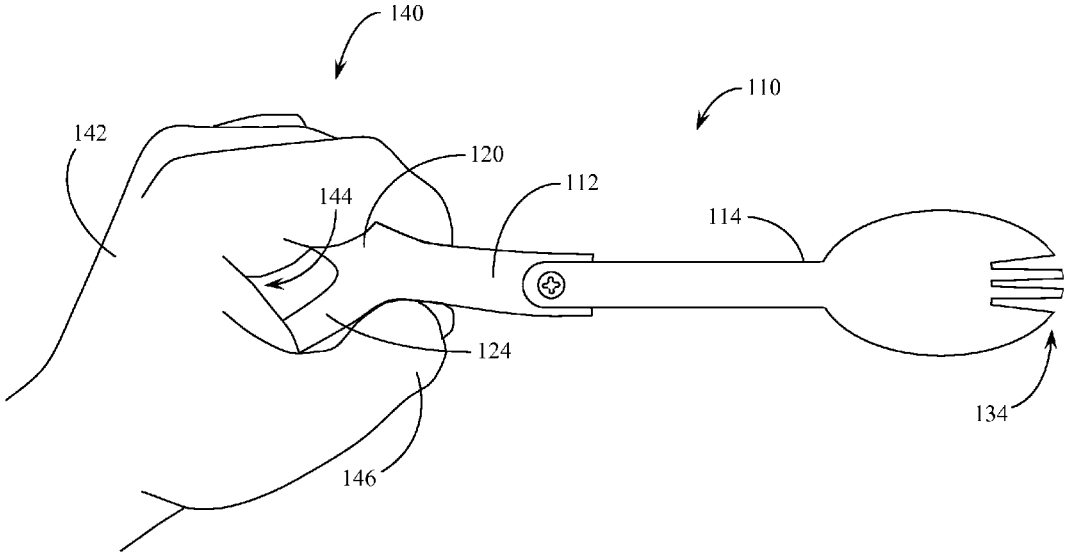
FIG. 9 is a perspective view of the utensil holding and turning device of the present invention as engaged by a human hand.

Reference is next made to FIG. 9, which is a perspective view of utensil holding and turning device 110 of the present invention as engaged by a human hand. It will be recognized by those skilled in the art that, although FIG. 9 represents the use of a left hand with the utensil holding and turning device 110, a mirror image of the device may easily be implemented with the right hand of the user in precisely the same manner. FIG. 9 shows the user's hand 140 engaging utensil holding and turning device 110 after having positioned the palm of the hand completely around the device. In FIG. 9 the back 142 of the hand is shown opposite the side where the palm of the hand (not shown) engages the device of the present invention. The thumb 146 extends around to an opposite side of the device from the balance of the hand, including the back of the hand and the four fingers as shown. Mid-way between the thumb 146 and the back 142 of the hand is the yoke of the hand 144, that extends around and grips the area of the handle engagement yolk 128 (not seen in this view) and which directs a gripping force around the wedge of the Y-shaped handle 112 through utensil 114 and utensil tip 134 to provide the necessary manipulation forces to direct the utensil to the material being manipulated and thereafter to leverage or otherwise lift and move the material as needed.

Rotation or leverage of utensil 114 once engaged with the material being manipulated is accomplished by the manner in which the palm of the hand (opposite the back 142 of the hand shown in FIG. 9) and the thumb 146 engage (surround) handle palm extension 120 and handle thumb extension 124, together. Alternately, with certain types of utensils that may specifically require a strong rotation, the user may switch to the manner of handle engagement described above with respect to the key turning embodiment. In any case, when the user holds the device in the manner shown in FIG. 9, he or she is able to direct both a longitudinal motion/force to secure the utensil in the material to be manipulated, and a rotating or leverage force to turn and/or lift the utensil in the material being manipulated. The combination of the frictional engagement forces between the palm of hand 140 and the handle palm extension 120, as well as the frictional forces of the curve of the thumb 146 and handle thumb extension 124, allow the user to generally maintain utensil holding and turning device 110 within the confines of the slightly closed and slightly gripped hand. Once again, an optional retention lanyard (not shown) may further support the retention of the device adjacent the user's hand even if some loosening of the grip occurs.

In contrast to previous efforts to provide large bulky (and heavy) handles for various utensils for those with limited manipulation or gripping abilities, the present invention provides a light weight, ergonomically configured wedge or Y-shaped handle that also serves to lift the attached utensil slightly above a flat surface such that it may be easily picked up for use. This beneficial shape may be established through the use of an appropriately chosen antler section or through the manufacture of the same shape from an artificial material as described above.

Although the present invention has been described in terms of the foregoing preferred embodiments, this description has been provided by way of explanation only, and is not intended to be construed as a limitation of the invention. Those skilled in the art will recognize modifications of the present invention that might accommodate specific utensils and structures. Those skilled in the art will further recognize additional methods for modifying the materials and construction of the device to accommodate variations in utensil size and type as well as hand size and grasping ability. Such modifications, as to structure, orientation, geometry, and even material composition and construction techniques, where such modifications are coincidental to the type of utensil or the specific requirements of the user, do not necessarily depart from the spirit and scope of the invention.

We claim:

1. A handle member for a utensil to facilitate the handling and manipulation of the utensil by the hand of a user, the handle member comprising:

a Y-shaped open yoke, the open yoke comprising:

a linear body section having a length, a longitudinal axis, a utensil end, and a thickness;

a first branch section forming a first lever arm extending from the linear body section, the first lever arm having a length, a longitudinal axis, and a terminal point; the longitudinal axis of the first lever arm forming a first acute angle with the longitudinal axis of the body section; and a second branch section forming a second lever arm extending from the linear body section, the second lever arm having a length, a longitudinal axis, and a terminal point, the longitudinal axis of the second lever arm forming a second acute angle with the longitudinal axis of the body section the second acute angle rotated from the longitudinal axis of the body section in a direction opposite that of the first acute angle, the longitudinal axes of the body section and the first and second lever arms intersecting at a common vertex; and an extension element connecting the utensil to the utensil end of the linear body section, the utensil generally aligned along the longitudinal axis of the linear body section;

whereby the user may engage the Y-shaped open yoke with their hand directing the thumb of the hand around one side of the open yoke and the palm of the hand around the opposing side of the open yoke so as to engage the first and second lever arms and thereby direct a manipulation of the handle member and the utensil to which it is connected about the longitudinal axis of the linear body section.

2. The handle member of claim 1 wherein the linear body section, the first branch section, and the second branch section, are formed from a unitary piece of material, and wherein:

the linear body section generally comprises a cylindrical solid extending from the common vertex of the open yoke to a region proximate the utensil end;

the first branch section generally comprises a tapered cylindrical solid extending from the common vertex of the open yoke to a narrow end at the terminal point of the branch; and the second branch section generally comprises a tapered cylindrical solid extending from the common vertex of the open yoke to a narrow end at the terminal point of the branch.

3. The handle member of claim 1 wherein the longitudinal axes of the body section and the first and second lever arms all generally extend within a common plane.

4. The handle member of claim 1 wherein at least one of the longitudinal axis of the body section, the longitudinal axis of the first lever arm, and the longitudinal axis of the second lever arm, extends outside of a common plane formed by the remaining two longitudinal axes, wherein placement of the handle member and connected utensil on a flat surface results in an elevation of the common vertex of the handle member above the flat surface.

5. The handle member of claim 4 wherein the longitudinal axis not coplanar with the remaining two longitudinal axes forms an elevational angle in the range of 10 to 30 degrees from the common plane.

6. The handle member of claim 2 wherein the unitary piece of material comprises at least a portion of an antler.

7. The handle member of claim 1 wherein the lengths of the lever arms of the first and second branch sections are each in the range of 1.5 to 6 inches measured from the common vertex.

8. The handle member of claim 1 wherein the first and second acute angles combine to form a third acute angle in the range of 20 to 80 degrees, the third acute angle comprising the angle between the first and second lever arms.

9. The handle member of claim 1 wherein the utensil comprises an eating utensil.

10. The handle member of claim 9 wherein the eating utensil comprises a combination spoon and fork.

* * * * *